US008365343B2

(12) United States Patent
Sherwood et al.

(10) Patent No.: US 8,365,343 B2
(45) Date of Patent: Feb. 5, 2013

(54) SINK DRAIN DEBRIS CLEARING IMPLEMENT

(76) Inventors: Leland J Sherwood, Boyne Falls, MI (US); Leonard G Sherwood, Boyne City, MI (US)

( * ) Notice: Subject to any disclaimer, the term of this patent is extended or adjusted under 35 U.S.C. 154(b) by 428 days.

(21) Appl. No.: 12/786,108

(22) Filed: May 24, 2010

(65) Prior Publication Data

US 2011/0283472 A1 Nov. 24, 2011

(51) Int. Cl.
*A47L 25/00* (2006.01)

(52) U.S. Cl. ..... 15/236.06; 15/104.001; 15/236.09; 4/255.01; 4/661; 30/315; 30/316; 81/488; D32/35; D32/49

(58) Field of Classification Search ..... 15/104.001, 15/104.03, 104.05, 104.16, 236.01, 236.05–236.1; 4/255.01, 661; 30/315, 316; 81/488, 489; 241/46.01, 46.013, 46.014, 46.017, 166; D32/35, 40, 46, 49
See application file for complete search history.

(56) References Cited

U.S. PATENT DOCUMENTS

| | | | | | |
|---|---|---|---|---|---|
| 745,717 | A | * | 12/1903 | Donaldson | 15/236.06 |
| 776,136 | A | | 11/1904 | Holden | |
| 874,756 | A | | 12/1907 | French | |
| 1,241,307 | A | * | 9/1917 | Tompkins | 366/129 |
| 1,678,488 | A | * | 7/1928 | Stillwaggon | 15/236.06 |
| 2,204,516 | A | * | 6/1940 | Stone | 15/236.06 |
| 2,479,485 | A | | 8/1949 | Frank | |
| D173,553 | S | * | 11/1954 | Chesney | D32/49 |
| 2,748,410 | A | * | 6/1956 | Chapman | 15/105 |
| 3,780,393 | A | * | 12/1973 | Gaetke | 15/105 |
| 5,141,166 | A | | 8/1992 | Maynard, Jr. | |
| 5,271,571 | A | | 12/1993 | Maynard, Jr. | |
| 6,637,684 | B1 | | 10/2003 | Ross et al. | |
| 7,159,810 | B1 | | 1/2007 | Miller | |
| 2007/0210195 | A1 | | 9/2007 | Chapman et al. | |
| 2007/0290082 | A1 | | 12/2007 | Scorvo et al. | |

* cited by examiner

*Primary Examiner* — Mark Spisich
(74) *Attorney, Agent, or Firm* — Waters & Associates PLC; John A. Waters

(57) ABSTRACT

An implement for clearing debris from a drain cup or basket strainer in a sink includes an upright handle for gripping and operating the implement. A cutting member configured to cut up the debris and force it through the drain cup or basket strainer is mounted on a lower end of the handle. The cutting member includes a centrally disposed recess for the strainer basket handle or the basket attachment nut in the drain cup. A plurality of radially extending grooves are formed in a lower surface of the cutting member with cutting edges being formed on the edges of the grooves for cutting the debris and forcing it through the drain cup or basket strainer. The recess in the cutting member permits the blades of the cutting assembly to reach the base of the strainer without interference from the strainer basket handle or attachment nut.

14 Claims, 4 Drawing Sheets

SINK DRAIN DEBRIS CLEARING IMPLEMENT

CROSS-REFERENCE TO RELATED APPLICATIONS

Not Applicable.

BACKGROUND OF THE INVENTION

To prevent debris, such as food waste, from clogging a sink drain, a sink is generally provided with a removable basket strainer that is mounted in a drain cup in the bottom of the sink. By catching the debris, the basket strainer does not eliminate drain blockages, it merely changes the position of the blockage from the drainage pipe or drain cup to the basket strainer itself. Accordingly, the debris causing the blockage is far more accessible. Once the debris is caught within the strainer, it must be dealt with to prevent the possibility of a drain blockage. While the strainer could be removed from the drain in order to empty the debris, one may not wish to reach into standing water filled with food waste. Also, the standing water in a sink may contain floating debris or other debris that has not settled onto the strainer. Removing the strainer for cleaning opens the drain outlet and allows such debris to enter and clog the drain cup outlet or form a blockage in the pipes further downstream. Thus, there is a need for an implement to clean debris from a basket strainer or drain cup before the debris forms a blockage in inaccessible downstream piping.

SUMMARY OF THE INVENTION

An implement for clearing debris from a basket strainer or a drain cup includes a handle for gripping and operating the implement. A cutting assembly configured to cut up the debris attaches to one end of the handle. The cutting assembly includes a recessed central portion that fits over the strainer button in the bottom of the basket strainer or the raised nut in the bottom of the drain cup. The opening accommodates the strainer button or the drain cup nut, such that the bottom and blades of the cutting assembly may bear against debris at the base of the strainer or drain cup and cut and force debris through the strainer or drain cup without interference from the button or nut.

BRIEF DESCRIPTION OF THE SEVERAL VIEWS OF THE DRAWING

The features and advantages of this invention, and the manner of attaining them will become more apparent and better understood by reference to the accompanying drawings, wherein.

DETAILED DESCRIPTION OF THE INVENTION

Figure 1:
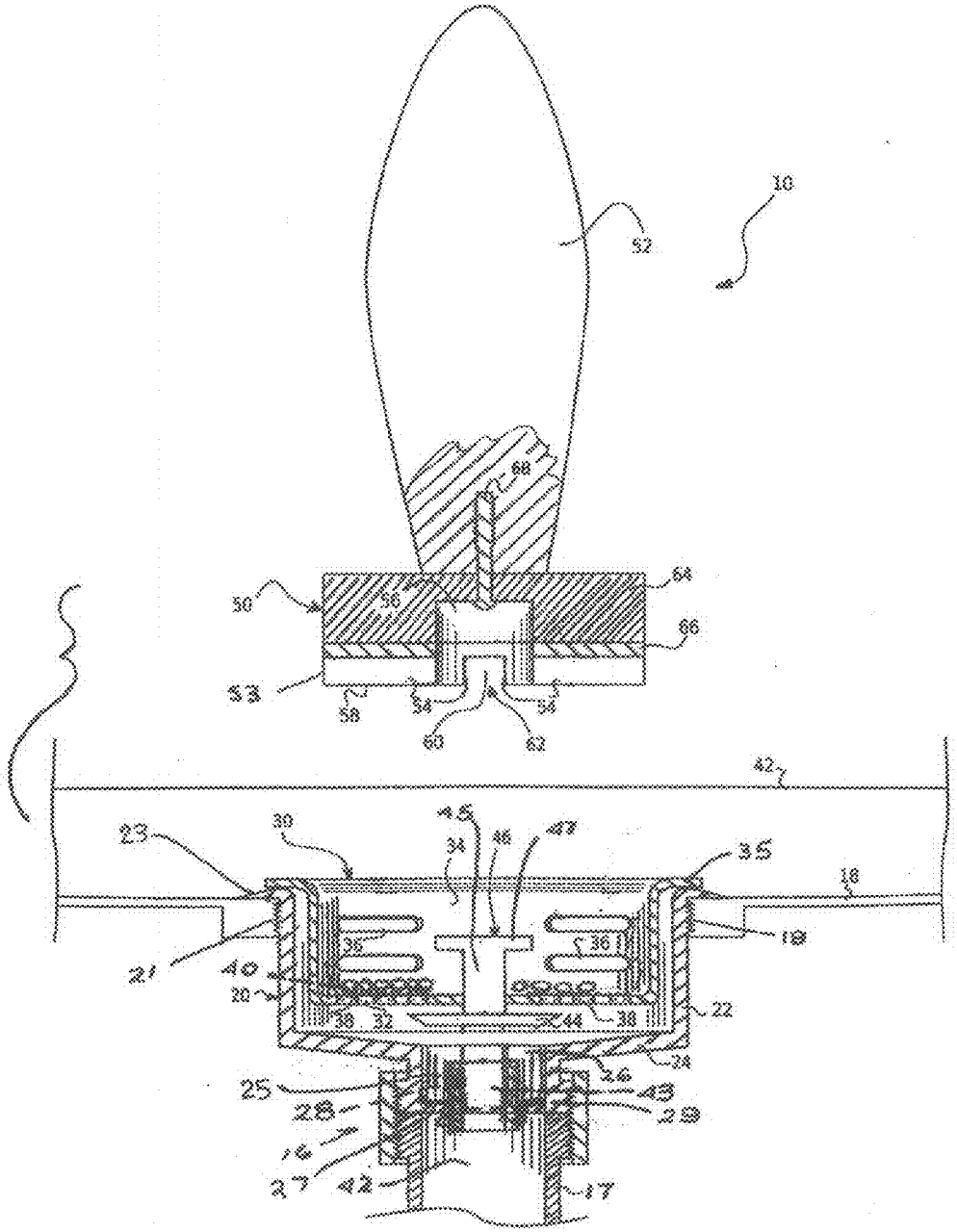
FIG. 1 is a cross sectional side view of a first embodiment of an exemplary debris clearing implement positioned above debris caught in a basket strainer placed in the drain of a sink.

It is to be understood that the present invention is not limited in application to the details of construction and the arrangement of components set forth in the following description or illustrations. The invention is capable of other exemplary approaches and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings merely provide exemplary approaches and other alternative mechanical configurations are possible.

Figure 2:
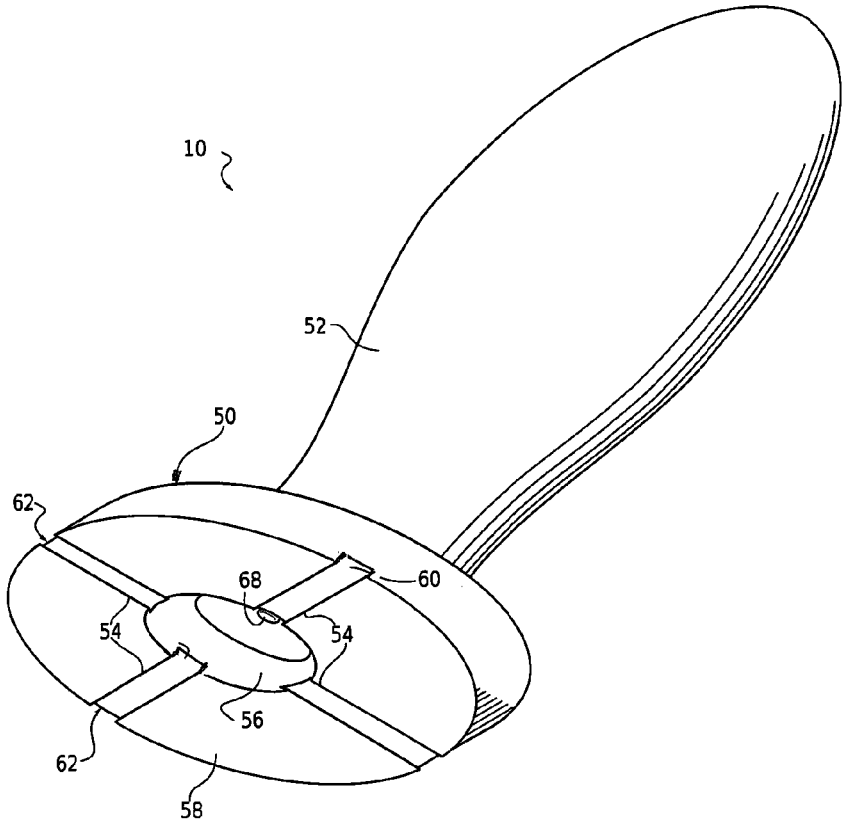
FIG. 2 is a perspective view of the debris clearing implement of FIG. 1.
Figure 3:
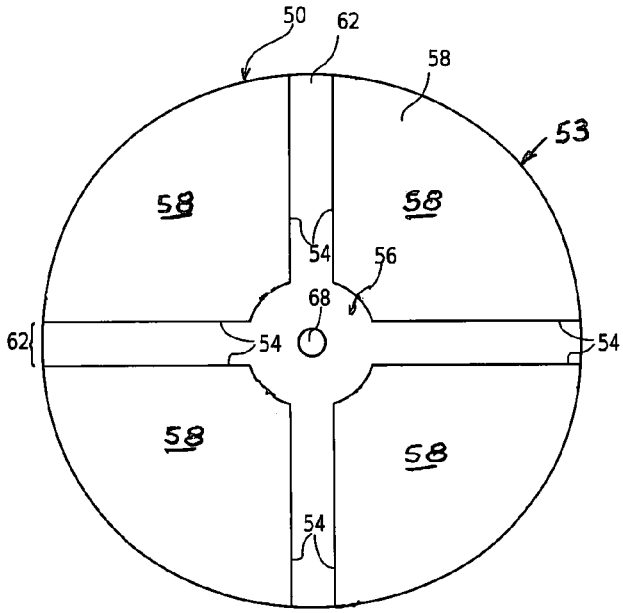
FIG. 3 is an end view of the debris clearing implement of FIG. 2 with radially disposed blades.

Referring now to the drawings, one embodiment of a drain debris clearing implement 10, and in particular an implement for clearing debris 40 from a basket strainer 30 positioned within a drain 16 of a sink 18, is shown in FIGS. 1-3. The sink 18, and the drain 16 thereof, can be prone to blockage, especially when used to clean food waste from food preparation and serving items. A so-called garbage disposal can be mounted in the sink to grind up blockage-forming food items that have entered the drain. However, even if a garbage disposal is present, it typically only services a single side of the common double-basin sink configuration (not shown). The other side of the sink usually includes a conventional drain of the type shown herein.

The sink 18, especially if it is a kitchen sink used for cleaning food waste, typically includes a drain cup 20 to interconnect the base of the sink basin with a drain pipe 17. Drain cup 20 includes an upper flange 23 that engages the upper surface of the sink surrounding the drain opening 21 in the sink. An annular sidewall 22 extends downwardly from the flange through the drain opening 21 in the sink. The sidewall can be a substantially cylindrical sidewall 22 and is usually at least partially threaded to interface with complimentary threads 19 on the sink 18. A downwardly and inwardly tapered cup base cup base 24 connects to the lower end of the sidewall 22 and provides an angled surface extending inwardly to the upper end of a recessed lower portion 25 of the drain cup. Lower portion 25 includes an annular sidewall or collar 29 and a bottom 27. The interior of the lower portion leads to arcuate drain outlet openings 26 that direct outlet water to drain pipe 17. An annular nut 28 is mounted in the bottom 27 of lower portion 25 and extends upwardly from bottom 27 at least part of the way through the interior of sidewall or collar 29.

A basket strainer 30 is configured to fit within the drain cup 20. The basket strainer 30 includes a circular base 32 with an annular sidewall 34 extending perpendicularly therefrom. An upper edge of the strainer sidewall 34 provides a lip or seal 35 to interface with the drain cup 20. A plurality of outlet holes 38 in base 32 allow for the passage of water 42 through the basket strainer 30 while preventing debris 40 from entering the drain 16. The basket can also have sidewall holes or slots 36 for the same purpose. The diameter of the strainer 30 sidewall 34 is somewhat less than the diameter of the drain cup 20, so water 42 can pass into the drain 16 through the sidewall openings.

In addition to straining debris 40 from the water 42, the basket strainer 30 includes a stopper 44 disposed below the strainer base 32 that is selectively movable vertically to open or close the drain 16. There are different types of stoppers. The illustrated stopper 44 is a circular component configured to cover and block the upper end of the lower portion 25 of the drain cup to close the sink outlet. The stopper 44 may be composed of rubber, metal, or plastic material, or the like, to provide a water tight seal with the upper end of collar 29.

A stopper button or handle 46 is disposed centrally to the strainer base 32 and comprises a vertical shaft 45 that passes through the base and extends parallel to the strainer sidewall 34. An upper end of the strainer handle 46 includes a grippable lip or wing nut type flange 47 or the like, while a lower portion thereof attaches to the stopper 44. A threaded shaft 43 extends downwardly from stopper 44. Shaft 43 engages internally threaded nut 28 that is mounted in the center of the bottom 27. The strainer button or handle 46 controls the position of stopper 44 to open and close the drain 16. Specifically, the handle 46 may be manipulated between at least a first and second position corresponding to an open and closed stopper 44 positions. In the illustrated embodiment, stopper 44 is opened and closed by rotating the handle 46. The threaded connection between the handle shaft 43 and nut 28 causes axial movement of the stopper to open and close the stopper. The basket strainer and stopper mechanisms are conventional.

In normal operation of a sink, the strainer 30 strains debris 40 from the water 42 to prevent the clogging of the drain 16. However, this debris 40 collects in the strainer 30 and blocks the strainer holes 38. Even when the remaining unobstructed holes allow the strainer 30 to continue to function, the collected debris 40 will need to be cleaned from the basket strainer once all of the water 42 has emptied into the drain 16. This cleaning task requires removal of the strainer basket or the unpleasant task of scraping the debris 40 out of the basket by hand.

A more serious problem arises when the debris obstructs all of the strainer holes and blocks the drain. The complete obstruction of the strainer holes 36, 38 halts the flow of water 42 from the sink into the drain 16. Thus, to restart the flow of water 42, the debris 40 must be cleared from the basket strainer 30. When removing the debris 40, the strainer 30 may be kept in place within the drain cup 20, or it may be removed therefrom. The first approach requires the user to undertake the unpleasant task of immersing a hand into the water 42 that has pooled in the sink 18 and picking the debris out of the strainer piece by piece. Alternatively, the basket strainer 30, including any collected debris 40, may be entirely removed from the drain cup 20. Once the strainer 30 is removed, the debris 40 in the strainer can be disposed of without any need for physical contact therewith. However, the removal of the basket strainer 30 also removes the protection provided thereby of the drain 16. As a result, other debris that remains in the water 42 may freely enter the drain cup 20 or drain 16 and clog the drain lines.

One embodiment of a debris cleaner implement 10 of the present invention allows for the removal of debris 40 obstructing a basket strainer 30 while the strainer is left in place. Debris cleaner implement 10 includes a cutting assembly 50 attached to a lower end of an upwardly extending grip or handle 52. The cutting assembly 50 includes a cylindrical member 53 having one or more radial cutting edges 54 formed in a generally flat lower end 58 thereof, the blades being configured to cut and shred debris 40 obstructing the flow of water 42 through the basket strainer 30. To accommodate the strainer basket button or handle 46, the cutting assembly 50 includes a button opening 56. In operation, the cutting assembly may be lowered over the basket strainer 30 with the button opening 56 accommodating the strainer button 46. Downward and rotary forces applied to the handle 52 cause the cutting assembly 50 and the blades 54 thereof to cut and shred the debris 40 obstructing the strainer 30 and push the cut debris 40 through the strainer holes 38 without removing the strainer basket.

In the illustrated embodiments, the cutting assembly 50 is a cylindrical member wherein the cutting edges of the blades 54 are disposed radially along a lower surface 58 thereof. The button opening 56 is a cylindrical void that is concentric with the cutting assembly 50. The diameter of the cutting assembly 50 is somewhat smaller than the diameter of the strainer sidewall 34. With a typical drain cup being about 2⅞ inches, the outer cylindrical member desirably is 1/16 inch or so less. Similarly, the size of the button opening 56 is larger than the diameter of the strainer button 46. Accordingly, the cutting assembly 50 is configured to fit within the void defined by the strainer sidewall 34 and strainer base 32 without interference from the strainer button 46.

In operation, debris 40 held by the basket strainer 30 will be compressed between the flat lower surface 58 of the cutting assembly 50 and the strainer base 32. As the blades 54 are rotated and pressed downwardly, they cut and shred the debris 40 to the extent that it can pass into the drain 16 without the risk of causing a clog. Pressure between the flat lower surface 58 and the strainer base 32 forces the cut debris through the openings 38 in the strainer base. The blades, being coplanar with surface 58, do not interfere with the downward pressure.

While the cutting assembly 50 could potentially include only a single cutting edge or blade 54, a plurality of cutting edges may be arranged around the lower surface of cylindrical member 53. As depicted, the cutting assembly 50 includes a plurality of sets of cutting edges, with each set being formed by a generally radial right angle groove 60 in the lower surface 58, with the edges of the groove forming a spaced pair of opposing blades 54. The blades 54 desirably are disposed at a right angle to the lower surface 58 of the cutting assembly 50. The gap formed by groove 60 between the cutting edges of each pair of opposing blades provides a debris opening 62. The debris opening 62 provides a space for a portion of debris 40 to be held prior to and after being cut by the blades 54. The downward force applied when using the implement 10 forces the debris 40 partly into the debris opening 62. Accordingly, the blades 54 do not merely scrape the surface of the debris 40, but rather cut off entire portions of the debris that have been pressed into the debris opening 62. The blades can be opposed outer edges on slots formed in the bottom surface 58 of cutting assembly 50 (FIGS. 2 and 3), or a separate blade can be attached to the lower end of a cylindrical base element (FIG. 1).

As shown in FIGS. 1-3, the blades 54 may extend from the button opening 56 to the outer edge of the cutting assembly 50. In this configuration, the debris opening 62 and button opening 56 form a continuous void that effectively increases the size of the button opening 56. The debris openings also serve as open ended channels to discharge debris from the channels through the ends of the channels. The exemplary channels desirably are about ⅛ inch wide and deep.

In the embodiment of FIG. 1, the cutting assembly 50 includes a cylindrical base element 64 and blade assembly 66 attached to the base element. The cutting edges 54, as described above, are formed by grooves 60 in the blade assembly 66 while the base element 64 provides an attachment point for attaching the cutting assembly 50 to the handle 52. Different materials can be used for the blade assembly 66 and the base element 64, which may be useful in reducing the component costs or assembly procedure. For example, the button opening 56 will need to accommodate the height of the strainer button 40, but it may not be practical or cost effective to produce the cutting assembly 50 with a single component or material. Accordingly, the blade assembly 66 could be a unitary metal element formed of aluminum or the like, in which the debris openings 62 have been machined as slots in the blade assembly to form the blades 54. The base element 64 could be a lower cost component composed of wood or plastic that is molded to, or otherwise attached to, the blade assembly 66.

The handle 52 extends away from the cutting assembly 50 to allow for the operation thereof. For example, the cutting assembly 50 may be submerged under water 42 contained in the sink 18 while at least a portion of the handle 52 remains above the water. An attachment element, such as a bolt 68, or the like, extends through the cutting assembly 50 and into the handle 52 to fixedly attach the assembly to the handle. The handle 52 may be composed of any suitable material, e.g., plastic, wood, metal, etc., and may be contoured to facilitate the gripping thereof by the hand of an operator. The handle 52 merely provides a rotary motion facilitation grip to allow for the remote rotation of the cutting assembly 50. Accordingly, any grippable element that extends out from the cutting assembly 50 and facilitates the rotary motion thereof may serve as the handle 52.

In operation, a user of the implement positions the cutting assembly 50 above the basket strainer 30, aligns the button opening 56 with the strainer button 46, and lowers the cutting assembly onto the debris 40. The user then rotates the cutting assembly 50 while pressing it down, using the gripping element or handle 52, which thereby cuts the debris 40 with the blades 54 disposed on the lower surface 58 of the cutting assembly. Moreover, downward pressure exerted on the handle 52 and cutting assembly 50 forces the debris 40 through the strainer outlet holes 38 into the drain outlet. The debris 40 in the basket strainer 30 then can be cleared from the strainer without removing the strainer and without handling the debris in the strainer with the hands. With the blades being flush with the bottom surface 58 and the flat bottom surface abutting the bottom the strainer basket, the edges of the blades do not protrude outwardly to abrade the strainer basket or interfere with the action of the flat bottom 58 of the cutting assembly in pressing the cut up debris through the strainer openings.

Figure 4:
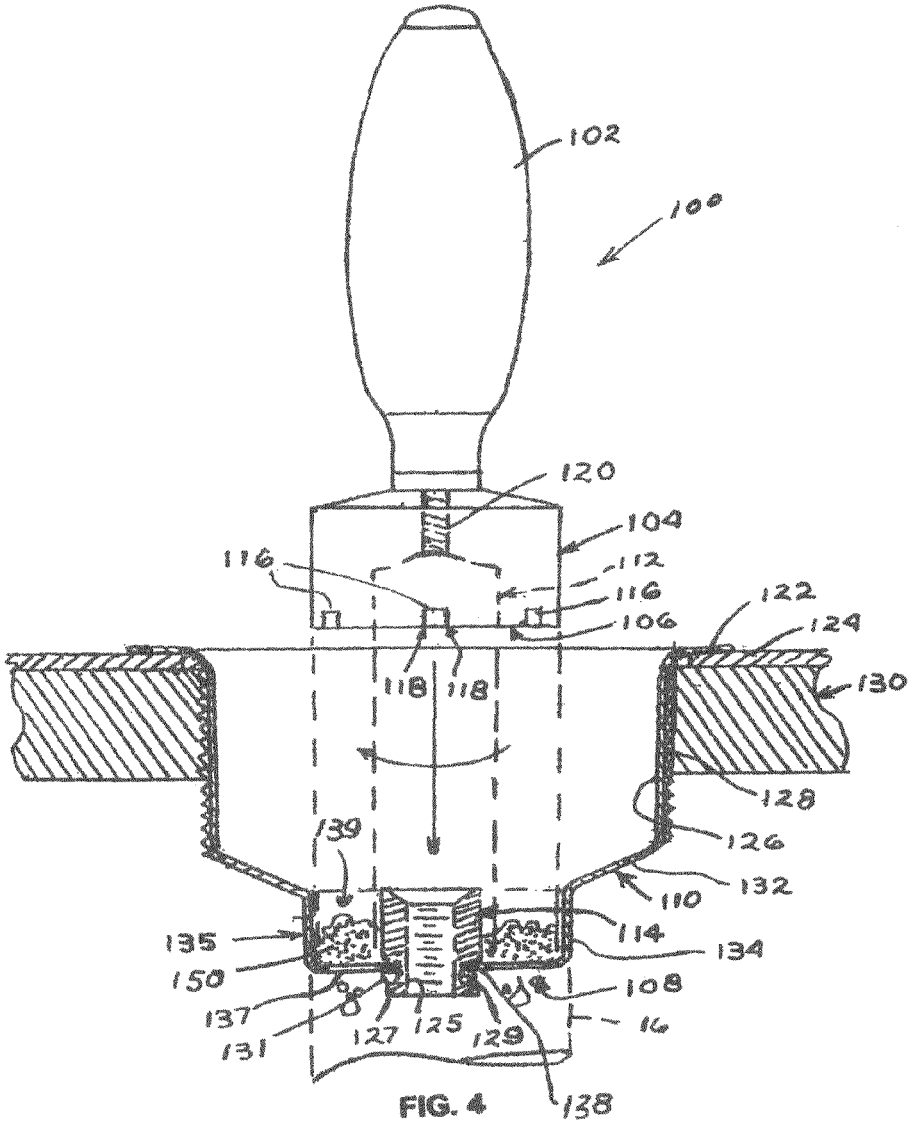
FIG. 4 is a partially cross sectional side view of a second embodiment of the present invention positioned above debris caught in a drain cup positioned in the outlet of a sink.
Figure 5:
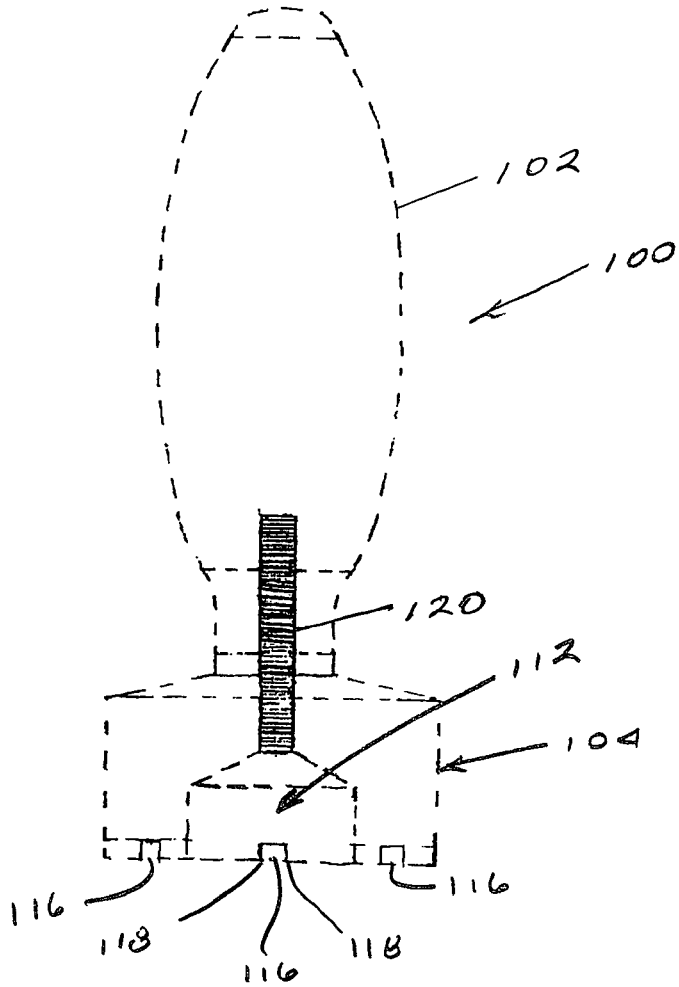
FIG. 5 is a side elevational view of the debris clearing implement of FIG. 4, with the exterior of the implement shown in phantom in order to illustrate the interior construction of the implement.
Figure 6:
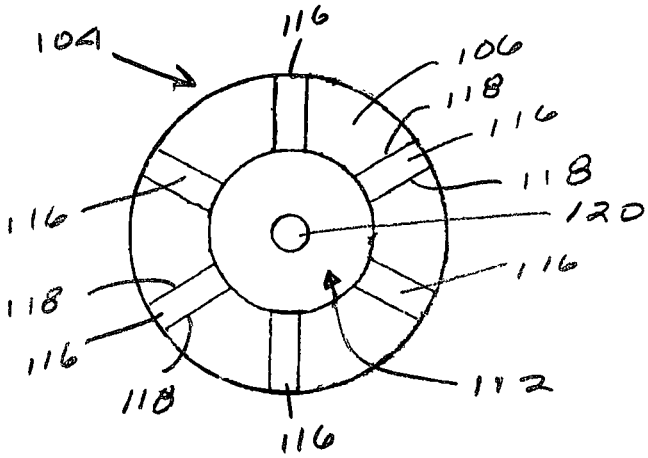
FIG. 6 is a lower end view of the debris clearing implement of FIGS. 4 and 5, showing the cutting blades.

A second and preferred embodiment of the present invention is shown in FIGS. 4-6. In this embodiment, the drain clearing implement is designed to fit in the drain cup as opposed to the basket strainer. Drain clearing implement 100 comprises a handle 102 in the form of a vertical shaft having a rounded exterior surface. The lower end of the handle is connected to a cylindrical member 104 having a generally flat bottom surface 106 that is shaped to mate with bottom surface 108 in drain cup 110. Cutting member 104 has a central internal recess 112 that is shaped to fit over a nut 114 that is mounted in the bottom 108 of drain cup 110. Radial grooves 116 are formed in the bottom surface 106 of the debris clearing implement. Grooves 116 have sharp edges on opposite lower sides thereof that serve as cutting surfaces for the debris clearing implement. As shown in FIG. 6, in the preferred invention, there are three equally spaced diametric grooves in the lower surface. In the exemplary embodiment these grooves are about ⅛ inch wide and deep.

Cylindrical member 104 is attached to a lower end of handle 102 by means of a screw 120 or other fastener.

Drain cup 110 includes an upper radial flange 122 that mounts on surface 124 in the bottom of a sink 130. Flange 122 is connected to an annular sidewall 126 that extends through opening 128 in sink 130. Sidewall 126 preferably has a threaded exterior, so that it can screw into the opening in sink 130.

The lower end of sidewall 126 is connected to a downwardly and inwardly tapered base wall 132 that is connected to an annular sidewall 134 of a lower portion 135 of the drain cup that extends downwardly to bottom 108. Bottom 108 includes openings 137 for water to pass through the bottom of the drain cup into drain pipe 16. Generally, such openings are arcuate slots. The drain cup in FIG. 4 is shown with the basket strainer removed.

Nut 114 is an annular member having internal threads 125 and a lower end 127 having a groove 129 therein. The lower end 127 fits through an opening 138 in the bottom 108 of the lower portion of the drain cup and locking ring 131 fits in groove 129 to lock the nut in place with its threaded internal surface facing upwardly.

As shown in FIG. 4, the internal recess 112 in cylindrical member 104 fits over nut 114 so that the bottom surface 106 of the cylindrical member can extend all the way down to bottom 108 of the drain cup.

In a typical embodiment of the present invention, the diameter of the cylindrical member 104 is about 1⅝ inches, and the internal recess has a diameter of about 1¾ inches. A 1/16 to ⅛ inch difference in diameter is desirable. The recess desirably is about 0.4-0.5 inches deep or sufficiently deep to cover nut 114. Grooves 116 are about ⅛ inch deep and ⅛ inch wide in the exemplary embodiment. This provides a sufficient cutting edge for cutting debris while minimizing recessed spacing in which debris can become lodged. Other groove sizes and dimensions can be employed.

The handle of exemplary embodiment of the present invention is about 3 inches or so long, with the entire cutting implement being about 4½ inches long. Other sizes and dimensions can be employed, as long as the cylindrical member 104 fits relatively closely inside lower portion 135 of the chain cup, and recess 112 is sufficiently wide and deep that the lower end 106 of the cylindrical member can extend all the way downwardly to bottom 108 of the lower portion of the drain cup, so that debris can be ground up and pushed through the openings 137 in the bottom 108 of the drain cup 110.

In operation, water is drained from a sink with the basket strainer (shown in FIG. 1) in position in the drain cup. When the drain cup either becomes clogged or the sink is drained, the drain cup is removed from the sink, and any remaining water or debris in the sink will then flow out of the sink through the openings 137 in the bottom 108 of drain cup 110 (FIG. 4). Debris 150 in the water that does not flow through openings 137 will collect and accumulate in the interior 139 of the lower 135 of the drain cup 110. The debris clearing implement is then introduced in the manner shown in FIG. 4 and pressed downwardly into the interior 139 of the lower portion 108 of the drain cup 110 and rotated to cut up and force the debris through openings 137 the bottom 108 of the drain cup 110. When the debris has been cut up and discharged from the drain cup 110, the drain cleaner implement can be removed, and the basket strainer replaced, thus providing an open drain cup for free flow of water through the drain into drain pipe 16.

While the foregoing is representative of the preferred practice of the present invention, various changes in the arrangements and details of construction of the embodiments disclosed herein may be made without departing from the spirit and scope of the present invention, as defined in the appended claims.

What is claimed is:

1. A drain cleaning implement for cleaning debris from a drain cup in a sink, wherein the drain cup includes a recessed lower portion having an annular sidewall that extends downwardly to a generally flat bottom having drain openings therein, with a raised basket strainer attachment nut extending upwardly from the center of the bottom, the drain cleaning implement comprising:

a generally cylindrical cutting member that fits inside the recessed lower portion of the drain cup, the cutting member having a lower end that abuts the bottom of the lower portion of the drain cup, the lower end of the cutting member having a recessed central portion that fits over the strainer attachment nut such that a lower surface of the cutting member can extend into abutting engagement with the bottom of the drain cup, the lower end including a plurality of cutting grooves therein with cutting edges on the grooves, such that downward pressure and rotation of the cutting member against debris in the lower portion of the drain cup causes the debris to be cut up by the cutting edges and pressed through the drain openings in the bottom of the drain cup by the lower surface of the cutting member; and a handle connected to an upper side of the cutting member and extending upwardly therefrom, the handle being grippable from a position above the cutting member and being manually rotatable so as to rotate and press down on the cutting member while the cutting member is positioned in the lower portion of the drain cup, downward pressure on the handle as it is rotated causing the cutting member to cut up debris and force it through the openings in the bottom of the lower portion of the drain cup, thereby clearing the drain cup.

2. The implement according to claim 1, wherein the cutting edges are formed on both opposed side edges of the grooves in the lower end of the cutting member.

3. The implement according to claim 1, wherein the implement includes at least two radial grooves positioned at spaced circumferential positions around the lower end of the cutting member.

4. The implement according to claim 3 wherein the implement includes six spaced radial grooves.

5. The implement according to claim 1, wherein the grooves in the cutting member comprise open outer ends for discharging debris out of the ends of the grooves.

6. The implement according to claim 1 wherein the implement has at least two opposed radial grooves and the grooves have open ends that connect with the recessed central portion.

7. A drain cleaning implement for cleaning debris from a basket strainer in a kitchen sink, wherein the basket strainer has a circular perforated base and an annular sidewall, with a stopper being movably mounted in the center of the base, the stopper having a stopper handle and being mounted on a vertically movable stopper handle shaft mounted in the basket, the drain cleaning implement comprising:

a cylindrical member shaped to fit inside the annular sidewall of the basket strainer, a lower surface of the cylindrical member having one or more grooves therein with cutting edges thereon, the lower surface abutting the perforated bottom of the basket strainer, the cutting edges being shaped to cut the debris in the strainer when the member is pressed downwardly against the debris and rotated axially, the cutting edges cutting the debris into small enough pieces that debris is pressed through the perforations in the bottom of the strainer by downward pressure and rotational movement of the cylindrical member against the debris, the member having a handle at an upper side, the handle being grippable to simultaneously rotate and press the member down against the bottom of the strainer to cut and force the debris through the strainer, the cylindrical member having a recess in the lower surface that fits over the stopper handle such that the lower surface of the cylindrical member can be pressed down against the perforated base of the strainer without interference from the stopper handle.

8. A drain cleaner as in claim 7 wherein the cutting edges of the drain cleaning implement comprise opposed outer edges of said one or more grooves in the lower surface of the cylindrical member, the cutting edges being formed on the edges of the grooves such that rotation of the member urges the cutting edges over the debris, the debris being urged into the grooves by the downward pressure and being cut up by the cutting edges.

9. A drain cleaner as in claim 8 where the cutting edges comprise edges on opposite sides of radial slots in the lower surface of the member.

10. A drain cleaner as in claim 9 wherein the slots are generally right angle slots.

11. A drain cleaner as in claim 9 wherein one or more of the slots extend radially outwardly from an open end connected to the recess for the stopper handle, to an open end at the outer edge of the lower surface of the cylindrical member.

12. A drain cleaner as in claim 10 wherein the slots are circumferentially spaced and extend outwardly from the stopper handle recess to the outer edge of the lower surface of the member.

13. A drain cleaner as in claim 11 wherein the drain cleaner includes at least two circumferentially spaced slots that extend from one outer edge of the lower surface to a diametrically opposite outer edge of the lower surface.

14. A drain clearing implement for clearing debris from a basket strainer in a sink, the basket strainer having a strainer handle, comprising:

an upright handle;

a cylindrical cutting member affixed to a lower end of the handle, the cutting member being of a size such that the cutting member fits within the basket strainer, the cutting member including one or more radially extending grooves in a lower end of the cutting member, with cutting edges being formed on one or more opposed outer side edges of the grooves; and a strainer handle opening in the lower end of the cutting member, the strainer handle opening being sufficiently large to receive the strainer handle therein while permitting the lower end of the cutting member to bear downwardly against debris in a bottom of the basket strainer.

* * * * *